US007051564B2

(12) United States Patent
Chang

(10) Patent No.: US 7,051,564 B2
(45) Date of Patent: May 30, 2006

(54) METHOD FOR MAKING A BICYCLE FRAME PART

(75) Inventor: Owen Chang, Taichung Hsien (TW)

(73) Assignee: Giant Manufacturing Co., Ltd., Taichung Hsien (TW)

( * ) Notice: Subject to any disclaimer, the term of this patent is extended or adjusted under 35 U.S.C. 154(b) by 0 days.

(21) Appl. No.: 10/932,033

(22) Filed: Sep. 2, 2004

(65) Prior Publication Data

US 2005/0092050 A1 May 5, 2005

Related U.S. Application Data

(63) Continuation-in-part of application No. 10/698,469, filed on Nov. 3, 2003, now Pat. No. 6,866,280.

(51) Int. Cl.

| | |
|---|---|
| ***B21D 26/02*** | (2006.01) |
| ***B21D 39/08*** | (2006.01) |
| ***B62R 9/00*** | (2006.01) |

(52) U.S. Cl. ..... 72/58; 72/61; 72/62; 280/281.1

(58) Field of Classification Search ..... 72/53, 72/55, 56, 57, 58, 59, 60, 61, 62, 63; 280/281.1

See application file for complete search history.

(56) References Cited

U.S. PATENT DOCUMENTS

| | | | | |
|---|---|---|---|---|
| 4,051,704 | A * | 10/1977 | Kimura | 72/58 |
| 4,305,269 | A * | 12/1981 | Kimura | 72/58 |
| 4,484,756 | A * | 11/1984 | Takamiya et al. | 280/281.1 |
| 4,580,427 | A * | 4/1986 | Akamatsu | 72/62 |
| 5,214,948 | A * | 6/1993 | Sanders et al. | 72/58 |
| 5,253,890 | A * | 10/1993 | Takamiya et al. | 280/281.1 |
| 6,264,880 | B1 * | 7/2001 | Elmer et al. | 72/56 |
| 6,862,910 | B1 * | 3/2005 | Amborn | 72/62 |
| 6,866,280 | B1 * | 3/2005 | Chang | 280/281.1 |

* cited by examiner

*Primary Examiner*—David B. Jones
(74) *Attorney, Agent, or Firm*—Harness, Dickey & Pierce, P.L.C.

(57) ABSTRACT

A method for making a bicycle frame part includes the steps of preparing a malleable tubular blank that has an outer surface and that is made from an alloy selected from the group consisting of Al—Mg—Sc alloy, Al—Mg—Zr alloy, and Al—Mg—Li—Zr alloy; placing the tubular blank in a mold such that the tubular blank is surrounded by an inner surface of the mold; heating the tubular blank to a working temperature ranging from 200 to 500° C; and injecting a high-pressure fluid into the tubular blank so as to permit expansion and permanent deformation of the tubular blank in the mold to an extent that the outer surface of the expanded tube abuts against and conforms to the inner surface of the mold.

4 Claims, 9 Drawing Sheets

METHOD FOR MAKING A BICYCLE FRAME PART

CROSS-REFERENCE TO RELATED APPLICATION

This application is a continuation-in-part (CIP) of U.S. patent application Ser. No. 10/698,469 filed by the applicant on Nov. 3, 2003 and now issued as U.S. Pat. No. 6,866,280, the entire disclosure of which is incorporated herein by reference.

BACKGROUND OF THE INVENTION

1. Field of the Invention

This invention relates to a method for making a tubular article, and more particularly to a method for making a bicycle frame part by injecting a high pressure fluid into a heated tubular blank in a mold.

2. Description of the Related Art

The frame of a bicycle includes a plurality of tubular frame parts that are assembled together through welding techniques. However, the welded areas on the frame parts have an adverse effect on the appearance of the bicycle. In addition, a large number of welding operations is required when assembling the frame parts, which results in an increase in manufacturing costs.

SUMMARY OF THE INVENTION

Therefore, the object of the present invention is to provide a method for making a bicycle frame part that is capable of overcoming the aforementioned drawbacks of the prior art.

According to the present invention, there is provided a method for making a bicycle frame part. The method comprises the steps of: preparing a malleable tubular blank that has an outer surface and that is made from an alloy selected from the group consisting of Al—Mg—Sc alloy, Al—Mg—Zr alloy, and Al—Mg—Li—Zr alloy; placing the tubular blank in a mold such that the tubular blank is surrounded by an inner surface of the mold; heating the tubular blank to a working temperature ranging from 200 to 500° C.; and injecting a high pressure fluid into the tubular blank so as to permit expansion and permanent deformation of the tubular blank in the mold to an extent that the outer surface of the expanded tube abuts against and conforms to the inner surface of the mold.

BRIEF DESCRIPTION OF THE DRAWINGS

In drawings which illustrate an embodiment of the invention.

DETAILED DESCRIPTION OF THE PREFERRED EMBODIMENT

Figure 1:
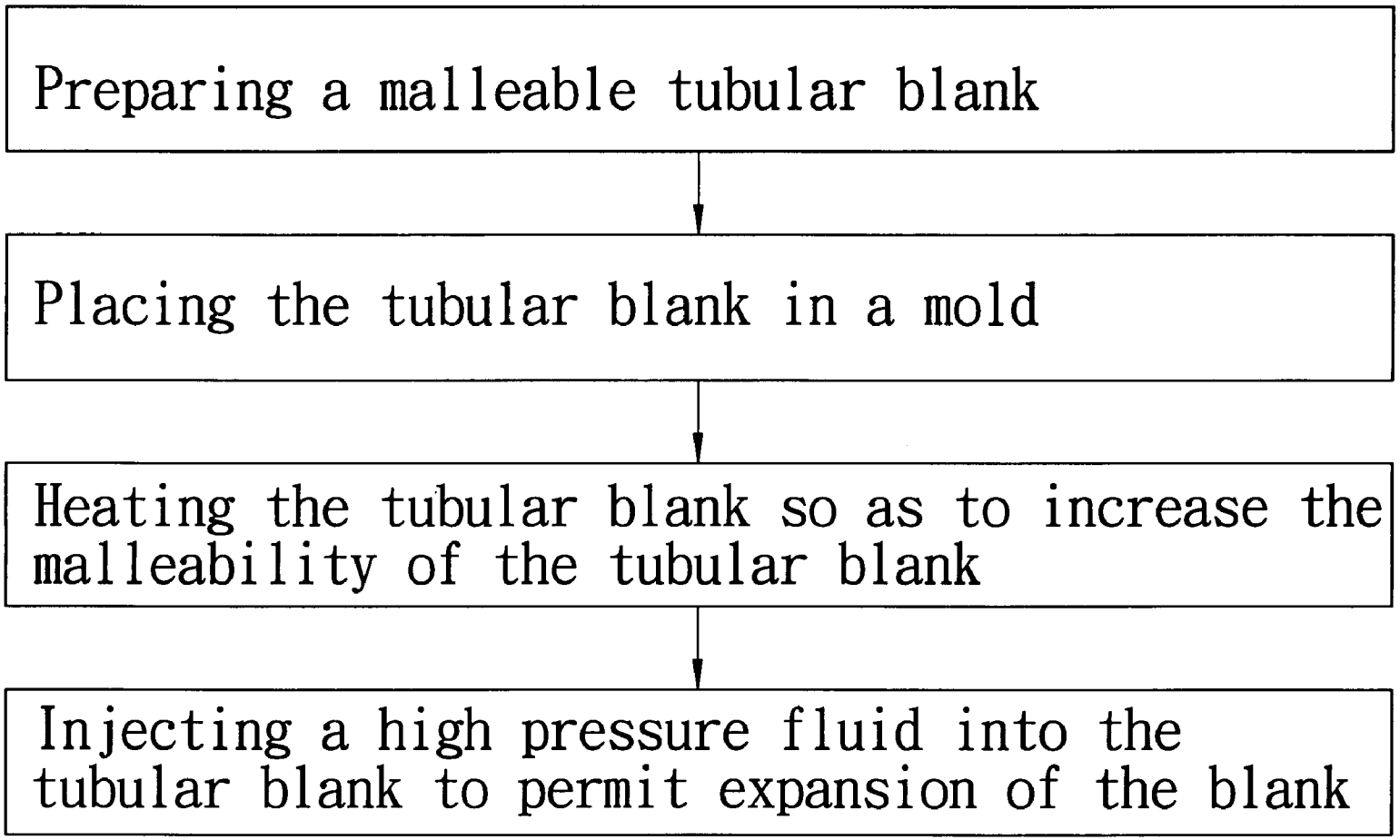
FIG. 1 is a flow diagram illustrating consecutive steps of the preferred embodiment of a method for making a bicycle frame part according to this invention.

Before the present invention is described in greater detail, it should be noted that same reference numerals have been used to denote like elements throughout the specification.

FIG. 1 illustrates an illustrative embodiment of a method for making a tubular article, such as a bicycle frame part, according to this invention.

The method includes the steps of: preparing a malleable tubular blank that has an outer surface and that is made from an alloy selected from the group consisting of Al—Mg—Sc alloy, Al—Mg—Zr alloy, and Al—Mg—Li—Zr alloy; placing the tubular blank in a mold such that the tubular blank is surrounded by an inner surface of the mold; heating the tubular blank to a working temperature ranging from 200 to 500° C. so as to increase the malleability of the tubular blank; and injecting a high pressure fluid into the tubular blank so as to permit expansion and permanent deformation of the tubular blank in the mold to an extent that the outer surface of the expanded tube abuts against and conforms to the inner surface of the mold.

The tubular blank is heated to the working temperature so as to facilitate expansion and deformation of the tubular blank in the mold during the injection of the high pressure fluid. In one example, the tubular blank can be heated to the working temperature by the mold, which is heated to a temperature above the working temperature of the tubular blank, or by a heating device before being placed in the mold. In another example, the tubular blank can also be heated by the high pressure fluid which is heated to the working temperature prior to injection into the tubular blank.

Example embodiments of the invention will now be described in greater detail in the following examples which show how different frame parts of a bicycle frame are formed according to the method of this invention.

Figure 2:
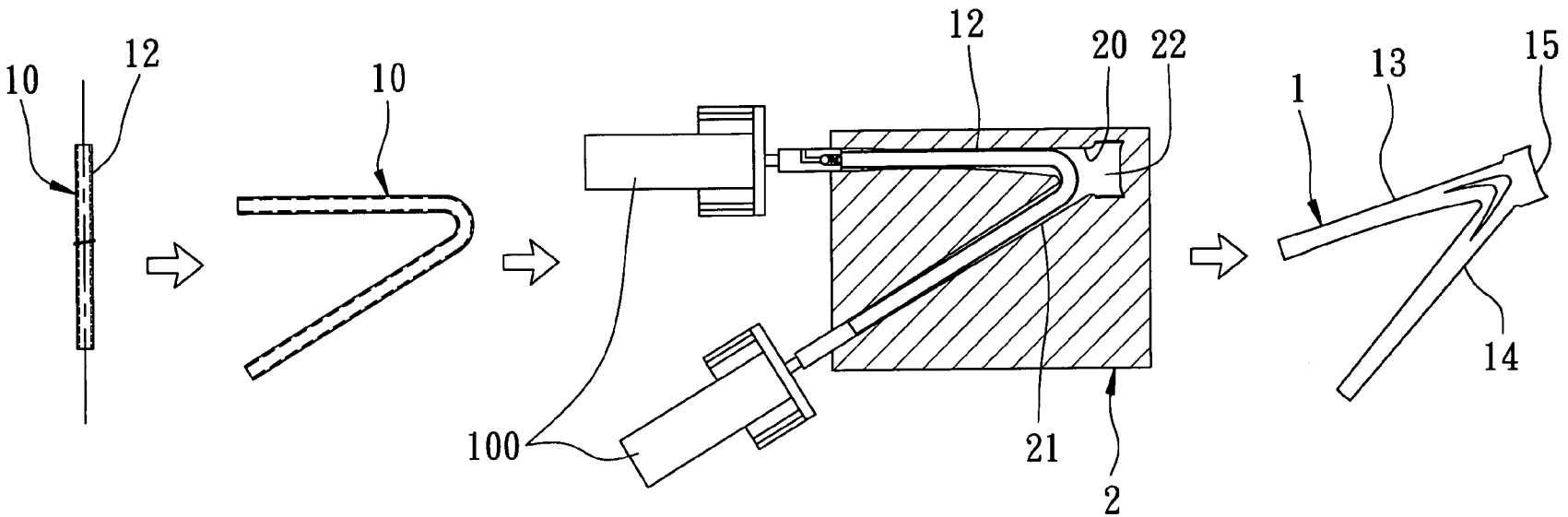
FIG. 2 is a schematic view illustrating consecutive steps of the preferred embodiment of this invention for making an assembly of a crossbar, a down tube and a head tube of a bicycle frame.

FIG. 2 illustrates the consecutive steps of how an assembly 1 of a head tube 15, a cross bar 13 and a down tube 14 of the bicycle frame is formed from a tubular blank 10 according to an example embodiment of this invention.

According to the method, the assembly 1 is formed by the following steps: (a) preparing the malleable tubular blank 10 having an outer surface 12; (b) bending the tubular blank 10; (c) placing the bent tubular blank 10 in a mold cavity 21 in a mold 2 such that the bent tubular blank 10 is surrounded by an inner surface 20 of the mold 2; and (d) injecting a high pressure fluid into the bent tubular blank 10 using an injecting device 100 so as to permit expansion and permanent deformation of the bent tubular blank 10 in the mold 2 to an extent that the outer surface 12 of the expanded tube 10 abuts against and conforms to the inner surface 20 of the mold 2. In this example, a protrusion, i.e., the head tube 15, is formed at the bend area of the bent tubular blank 10 as a result of expansion of the tubular blank 10 into a recess 22 in the inner surface 20 of the mold 2 during the injection of the high pressure fluid into the bent tubular blank 10. The head tube 15 interconnects the cross bar 13 and the down tube 14. Note that the tubular blank 10 is heated to a temperature ranging from 200 to 500° C. prior to expansion of the tubular blank 10 so as to facilitate expansion of the tubular blank 10 and so as to form the tubular blank 10 into a part having a desired shape and uniform surface and cross-section.

Figure 3:
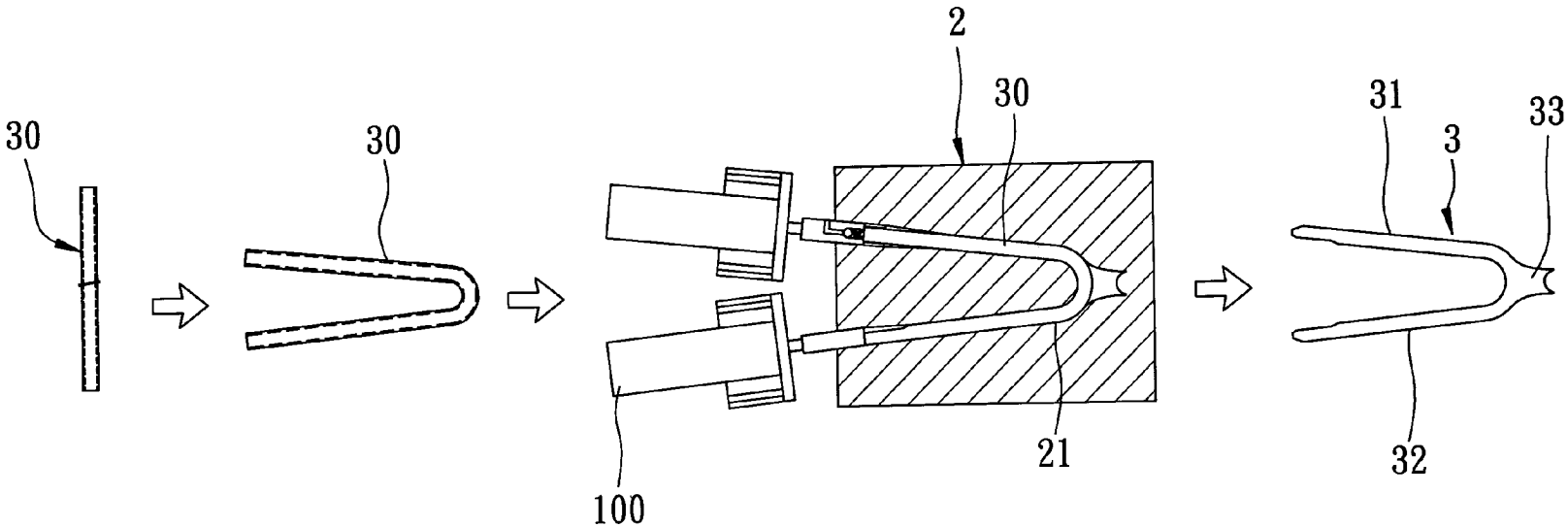
FIG. 3 is a schematic view illustrating consecutive steps of the preferred embodiment of this invention for making a seat stay of the bicycle frame.

FIG. 3 illustrates the consecutive steps of how a seat stay 3 of the bicycle frame is formed from a straight tubular blank 30 according to another example method of the invention. The seat stay 3 is V-shaped, and includes two legs 31, 32, and a leg-connecting part 33 interconnecting the legs 31, 32. The process of forming the seat stay 3 is similar to that of the assembly 1 shown in FIG. 2.

Figure 4:
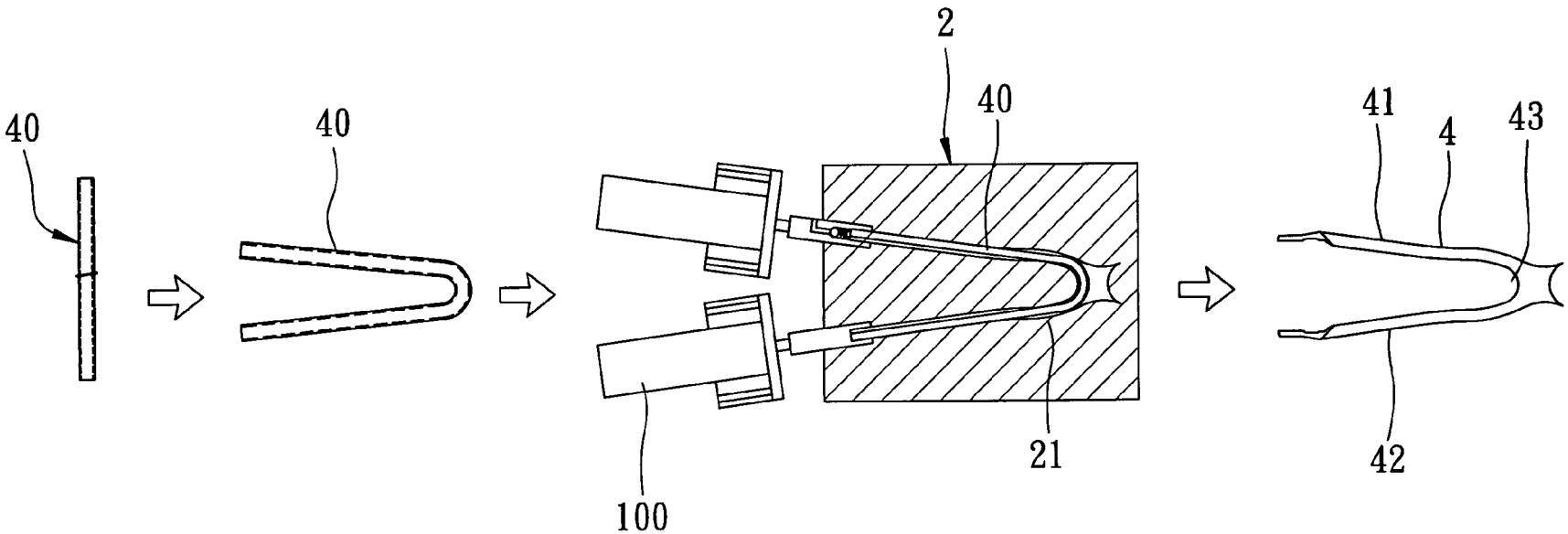
FIG. 4 is a schematic view illustrating consecutive steps of the preferred embodiment of this invention for making a chain stay of the bicycle frame.

FIG. 4 illustrates the consecutive steps of how a chain stay 4 of the bicycle frame is formed from a straight tubular blank 40 according to another example method of the invention. The chain stay 4 is V-shaped, and includes two arms 41, 42, and an arm-connecting part 43 interconnecting the arms 41, 42. The process of forming the chain stay 4 is similar to that of the seat stay 3 shown in FIG. 3.

Figure 5:
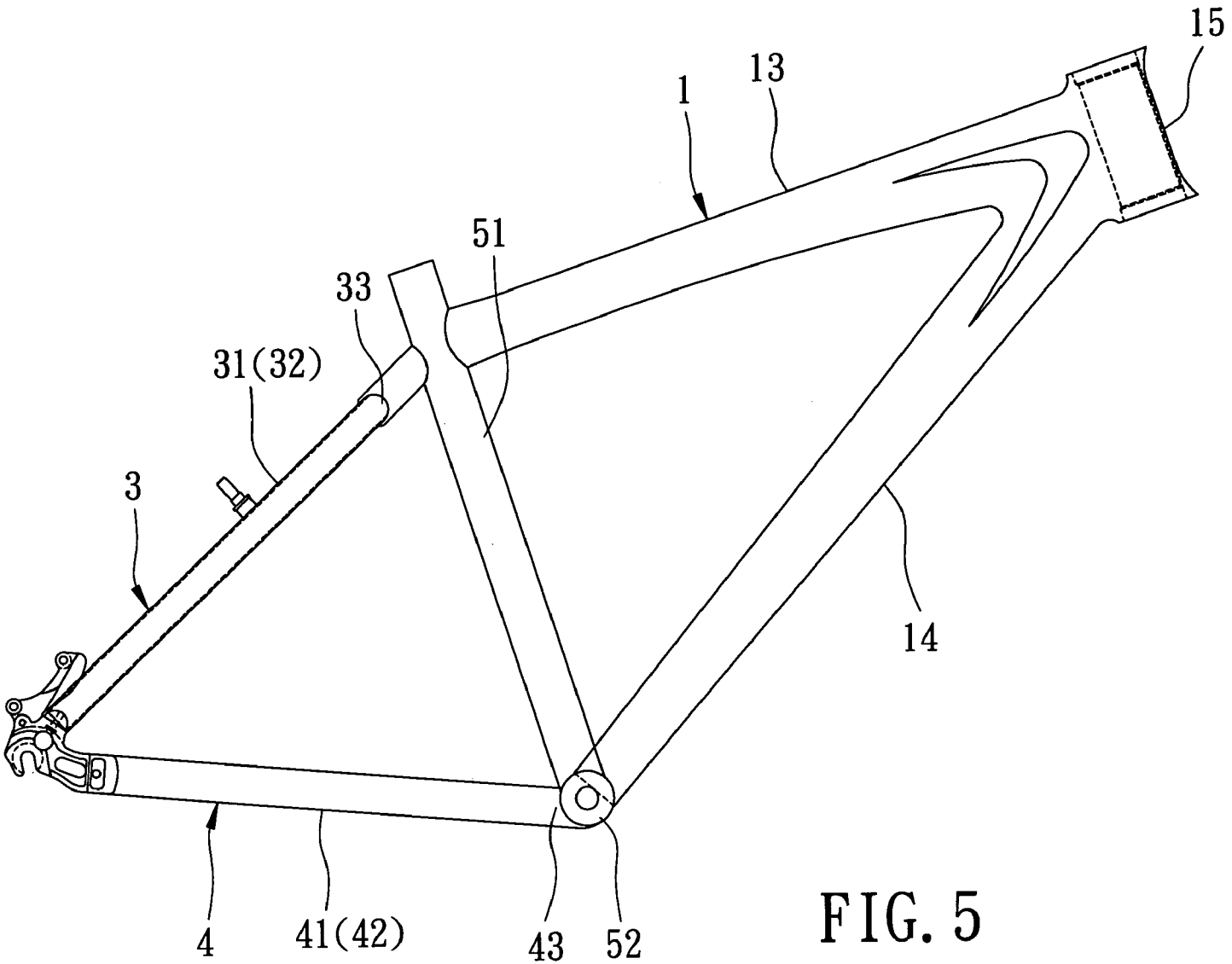
FIG. 5 is a schematic view of an assembly of a seat tube, the chain stay of FIG. 4, the seat stay of FIG. 3, and the assembly of FIG. 2.

FIG. 5 illustrates a frame part of the bicycle frame which is formed by assembling the chain stay 4 shown in FIG. 4, the seat stay 3 shown in FIG. 3, the assembly 1 shown in FIG. 2, a seat tube 51, and a five-way tube 52 together through welding techniques. The number of pieces to be welded to form the frame part shown in FIG. 5 is considerably less as compared to the number of pieces required by conventional methods.

Figure 6:
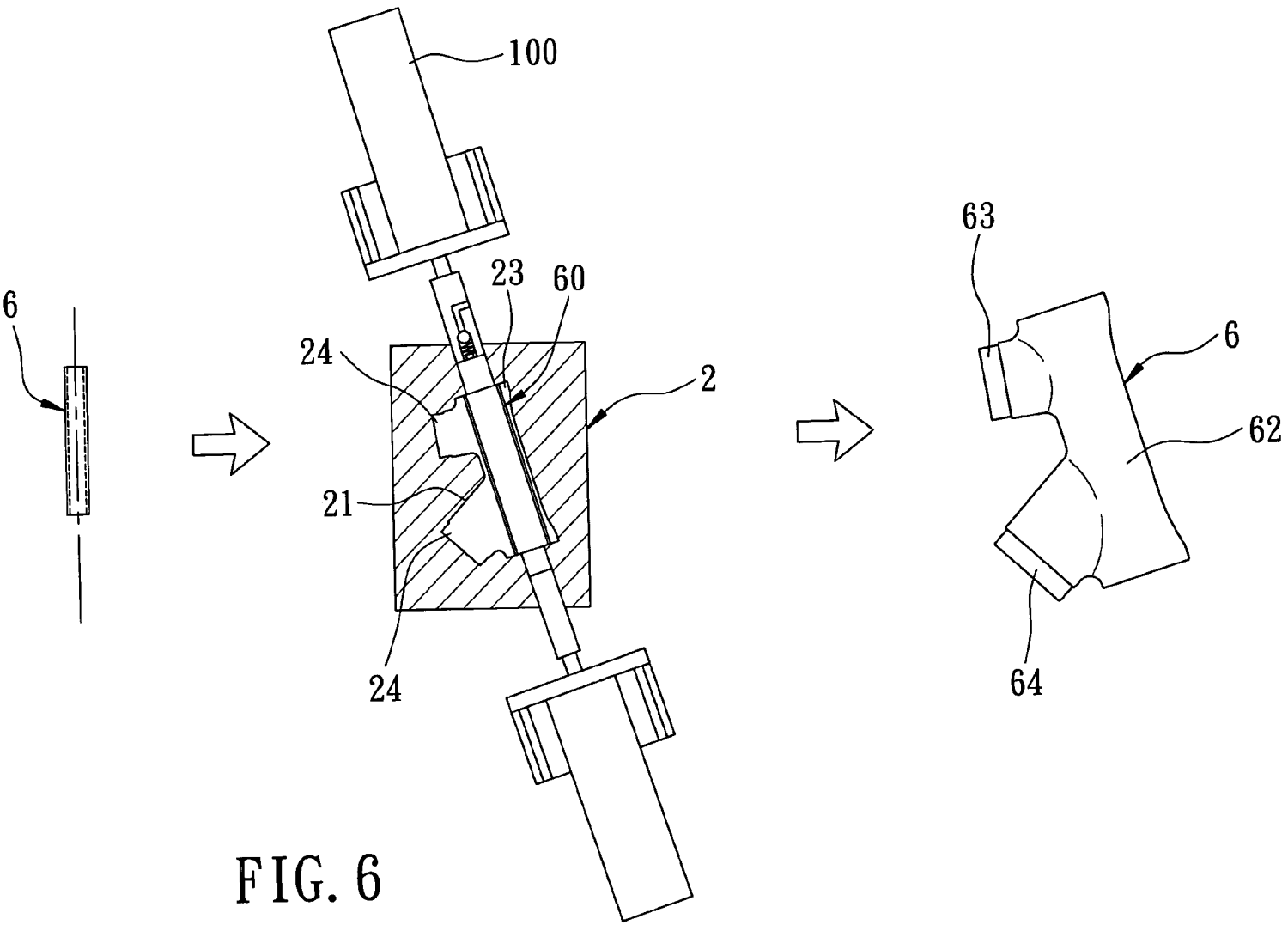
FIG. 6 is a schematic view illustrating consecutive steps of the preferred embodiment of this invention for making a head tube of the bicycle frame.

FIG. 6 illustrates the consecutive steps of how a head tube 6 of the bicycle frame is formed from a straight tubular blank 60 according to an example method of the invention. The head tube 6 includes a head body 62 and two branches 63, 64 branching from the head body 62. The process of forming the head tube 6 is similar to that of the assembly 1 shown in FIG. 1, except that no bending operation is required for this example. To form the head tube 6, the mold cavity 21 in the mold 2 is configured to have a main region 23 for receiving the tubular blank 60 therein, and two branch regions 24 that diverge from the main region 23 so as to permit expansion of the tubular blank 60 into the branch regions 24 to form the branches 63, 64.

Figure 7:
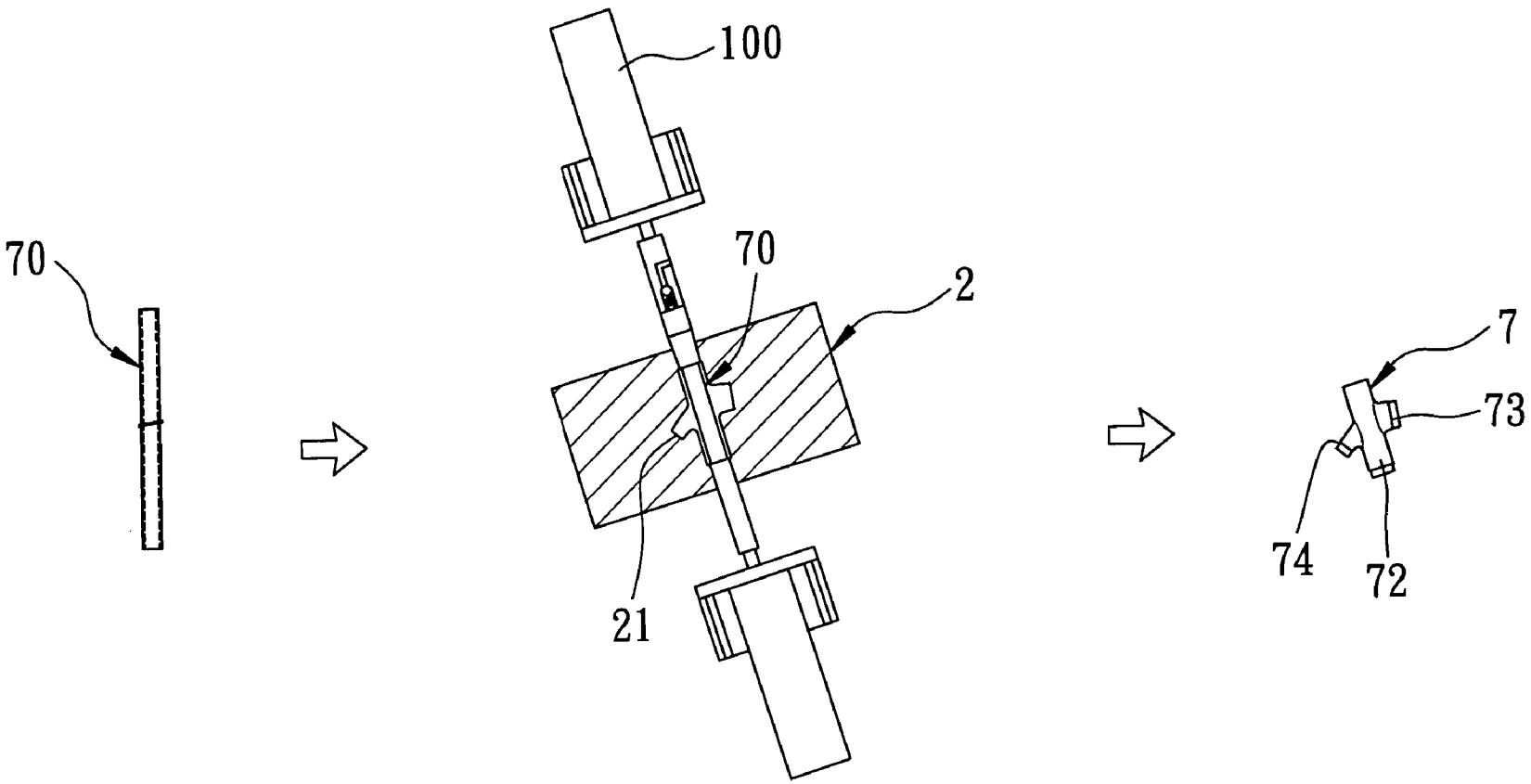
FIG. 7 is a schematic view illustrating consecutive steps of the preferred embodiment of this invention for making a four-way tube of the bicycle frame.

FIG. 7 illustrates the consecutive steps of how a four-way tube 7 of the bicycle frame is formed from a straight tubular blank 70 according to an example method of this invention. The four-way tube 7 includes a straight part 72, and two branches 73, 74 branching from the straight part 72. The straight part 72 has two end portions respectively defining another two branches so that the four-way tube 7 has four connecting ends that can be used for connecting to up to four parts of the bicycle frame. The process of forming the four-way tube 7 is similar to that of the head tube 6 shown in FIG. 6.

Figure 8:
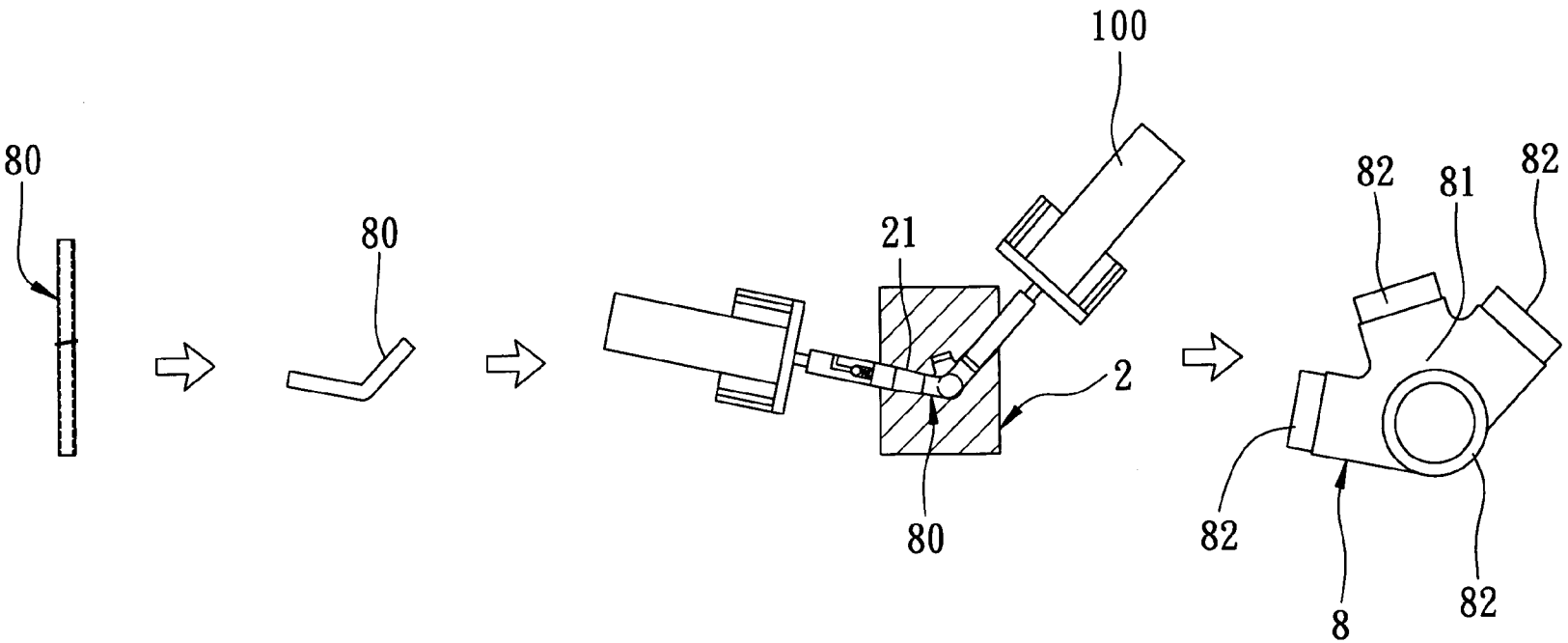
FIG. 8 is a schematic view illustrating consecutive steps of the preferred embodiment of this invention for making a five-way tube of the bicycle frame.

FIG. 8 illustrates the consecutive steps of how a five-way tube 8 of the bicycle frame is formed from a straight tubular blank 80 according to an example method of the invention. The five-way tube 8 includes a central part 81, and five branches 82 (only four are visible in FIG. 8) branching from the central part 82. The process of forming the five-way tube 8 is similar to that of the four-way tube 7 shown in FIG. 7, except that the tubular blank 80 is bent before being placed in the mold 2.

Figure 9:
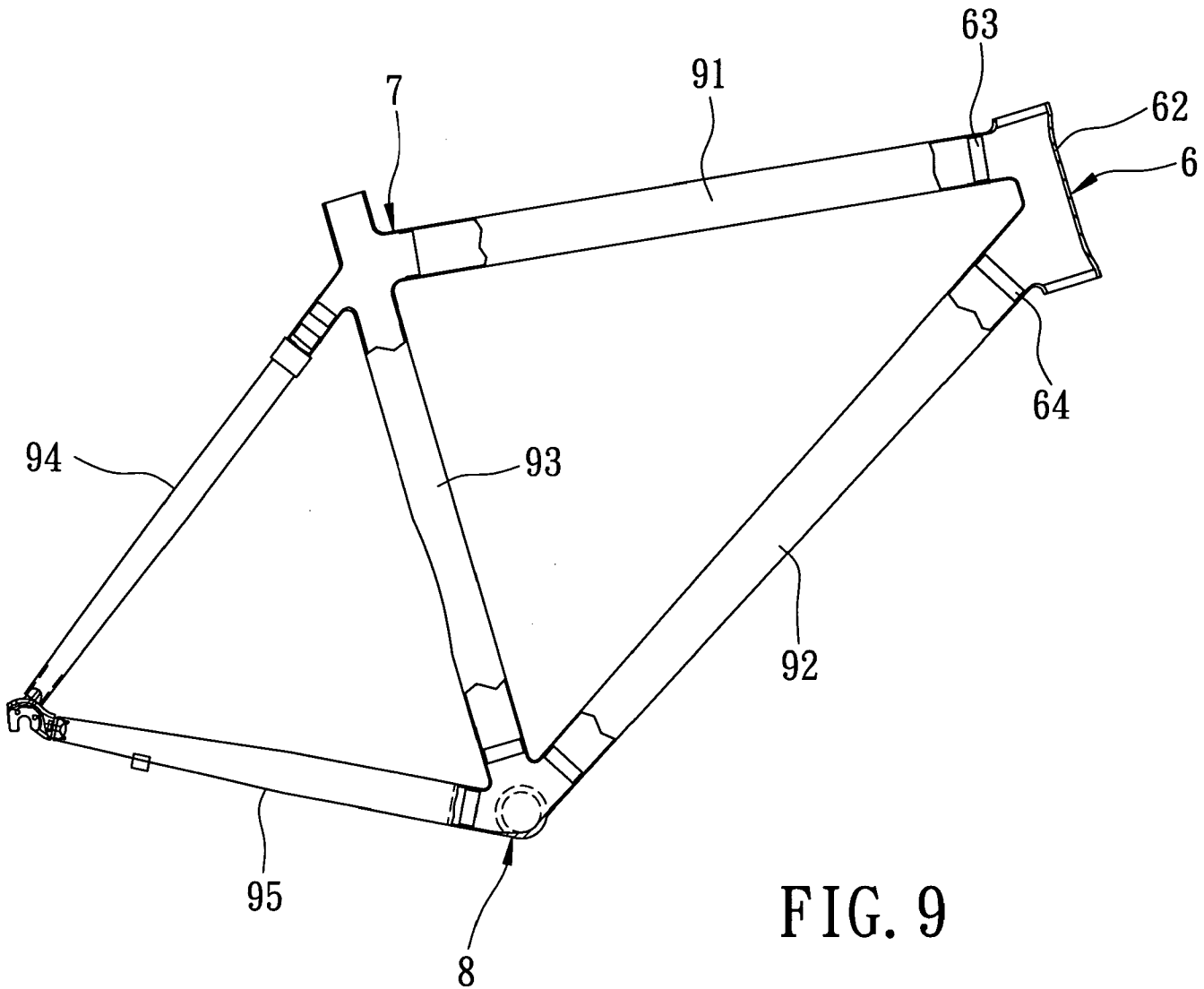
FIG. 9 is a schematic view illustrating an assembly of a seat tube, a down tube, a cross bar, the head tube of FIG. 6, the four-way tube of FIG. 7, and the five-way tube of FIG. 8.

FIG. 9 illustrates a frame part of the bicycle frame which is formed by assembling the head tube 6 shown in FIG. 6, the four-way tube 7 shown in FIG. 7, the five-way tube 8 shown in FIG. 8, a cross bar 91, a down tube 92, a seat tube 93, a seat stay 94, and a chain stay 95 together through welding techniques. The number of pieces to be welded to form the frame part shown in FIG. 9 is considerably less than the number of pieces required by conventional methods.

Since the tubular article, such as the head tube 6, the four-way tube 7, the five-way tube 8, the seat stay 3, the chain stay 4, and the assembly 1 of the head tube, the down tube, and the cross bar, is formed by expansion of a tube in a mold according to this invention, the number of welding operations for forming the bicycle frame can be significantly reduced, thereby eliminating the aforesaid drawbacks associated with the prior art. Moreover, since the malleability of the tubular blank is considerably increased after the tubular blank is heated to the working temperature prior to expansion in the mold, formation of the frame part is facilitated, and a desired shape and uniform surface and cross-section of the frame part can be achieved.

With the invention thus explained, it is apparent that various modifications and variations can be made without departing from the spirit of the present invention. It is therefore intended that the invention be limited only as recited in the appended claims.

I claim:

1. A method for making a bicycle frame part, comprising the steps of:

preparing a malleable tubular blank that has an outer surface and that is made from an alloy selected from the group consisting of Al—Mg—Sc alloy, Al—Mg—Zr alloy, and Al—Mg—Li—Zr alloy;

placing the tubular blank in a mold such that the tubular blank is surrounded by an inner surface of the mold;

heating the tubular blank to a working temperature ranging from 200 to 500° C.; and injecting a high pressure fluid into the tubular blank so as to permit expansion and permanent deformation of the tubular blank in the mold to an extent that the outer surface of the expanded tube abuts against and conforms to the inner surface of the mold.

2. The method of claim 1, wherein the mold is heated to a temperature above the working temperature so as to heat the tubular blank to the working temperature prior to the injection of the high pressure fluid into the tubular blank.

3. The method of claim 1, wherein the tubular blank is heated to a temperature ranging from 200 to 500° C. before being placed in the mold.

4. A method for making a bicycle frame part, comprising the steps of:

preparing a malleable tubular blank that has an outer surface and that is made from an alloy selected from the group consisting of Al—Mg—Sc alloy, Al—Mg—Zr alloy, and Al—Mg—Li—Zr alloy;

placing the tubular blank in a mold such that the tubular blank is surrounded by an inner surface of the mold;

heating a high pressure fluid to a temperature ranging from 200 to 500° C.; and injecting the heated high pressure fluid into the tubular blank so as to permit expansion and permanent deformation of the tubular blank in the mold to an extent that the outer surface of the expanded tube abuts against and conforms to the inner surface of the mold.

* * * * *